US012799408B2

(12) United States Patent
Hatakeyama et al.

(10) Patent No.: US 12,799,408 B2
(45) Date of Patent: Nov. 17, 2026

(54) METHOD OF REMOVING HEAVY METALS FROM HYDROCARBON LIQUIDS BY REACTION AND EXTRACTION

(71) Applicant: CHEVRON U.S.A. INC., San Ramon, CA (US)

(72) Inventors: Evan Shigeto Hatakeyama, San Ramon, CA (US); Nga Malekzadeh, San Ramon, CA (US); Joshua Allen Thompson, San Ramon, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 192 days.

(21) Appl. No.: 18/780,846

(22) Filed: Jul. 23, 2024

(65) Prior Publication Data

US 2026/0028534 A1 Jan. 29, 2026

(51) Int. Cl.
*C10G 21/22* (2006.01)

(52) U.S. Cl.
CPC ..... *C10G 21/22* (2013.01); *C10G 2300/205* (2013.01)

(58) Field of Classification Search
CPC ..... C10G 21/22; C10G 2300/205
USPC ..... 585/865
See application file for complete search history.

(56) References Cited

U.S. PATENT DOCUMENTS

2012/0125816 A1* 5/2012 Young ..... C02F 1/722 208/187

* cited by examiner

*Primary Examiner* — Prem C Singh
*Assistant Examiner* — Francis C Campanell
(74) *Attorney, Agent, or Firm* — HUNTON ANDREWS KURTH LLP

(57) ABSTRACT

The present application relates generally to processes, systems, and compositions for removing one or more heavy metals from liquid hydrocarbons. In one embodiment, the application pertains to a method comprising dissolving one or more heavy metals within the hydrocarbons with an additive composition. The dissolved one or more heavy metals from the hydrocarbons are extracted into an aqueous phase. The aqueous phase is separated from the hydrocarbons. The additive composition generally comprises an effective amount of a heavy metal dissolving additive.

17 Claims, 6 Drawing Sheets

METHOD OF REMOVING HEAVY METALS FROM HYDROCARBON LIQUIDS BY REACTION AND EXTRACTION

FIELD OF THE INVENTION

The present invention relates generally to processes, systems, and compositions for removing heavy metals from liquid hydrocarbons.

BACKGROUND AND SUMMARY

What is needed are improved processes, systems, and compositions for reducing, i.e., decreasing, or removing one or more mercury species in liquid hydrocarbons such as crudes, condensates, slop oil, and/or distillates. Ideally, such improved processes, systems, and compositions would be cost-efficient and energy efficient. It would further be beneficial if such processes also removed other heavy metals such as arsenic species and/or selenium and/or did not require high temperatures and/or pressures. Advantageously, the instant application meets one or more of the aforementioned needs.

The present application relates generally to processes, systems, and compositions for removing one or more heavy metals from liquid hydrocarbons. In one embodiment, the application pertains to a method comprising dissolving one or more heavy metals within the hydrocarbons with an additive composition. The dissolved one or more heavy metals from the hydrocarbons are extracted into an aqueous phase. The aqueous phase is separated from the hydrocarbons. The additive composition generally comprises an effective amount of a heavy metal dissolving additive.

The processes are widely applicable to hydrocarbons including to crude oil, condensates, and slop oils in upstream operations. The processes are also applicable to feed blends, slop oils from effluent treatment plant operations, and sludges from maintenance activities in downstream operations. Such removal of heavy metals may be advantageous in order to reduce the frequency of catalyst guard bed replacement.

BRIEF DESCRIPTION OF THE DRAWINGS

So that the way the above recited features, advantages, and objects of the present invention are attained and can be understood in detail, a more particular description of the invention, briefly summarized above, may be had by reference to the embodiments thereof which are illustrated in the appended drawings. It is to be noted, however, that the appended drawings only illustrate preferred embodiments of this invention and are therefore not to be considered limiting of its scope, for the invention may admit to other equally effective embodiments that vary only in detail. In the drawings.

DETAILED DESCRIPTION

Figure 1:
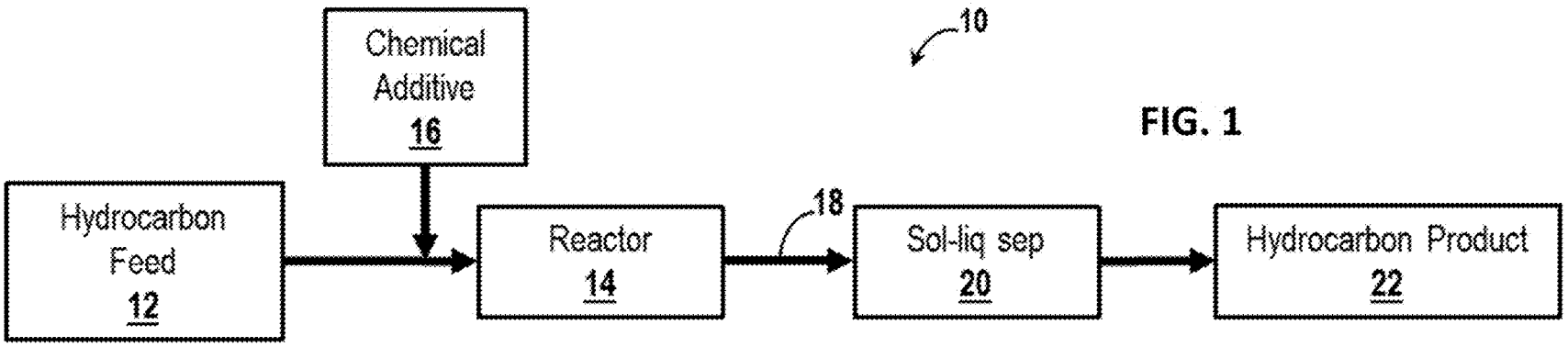
FIG. 1 depicts steps of a representative process.

Certain terms are used throughout the following description and claims to refer to particular system components. As one skilled in the art will appreciate, different companies may refer to a component by different names.

Definitions

The terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. For example, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Accordingly, these terms are intended to not only cover the recited element(s) or step(s) but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%. Furthermore, a range may be construed to include the start and the end of the range. For example, a range of 10% to 20% (i.e., range of 10%-20%) includes 10% and also includes 20%, and includes percentages in between 10% and 20%, unless explicitly stated otherwise herein. Similarly, a range of between 10% and 20% (i.e., range between 10%-20%) includes 10% and also includes 20%, and includes percentages in between 10% and 20%, unless explicitly stated otherwise herein.

The term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C. In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C). In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have elements that do not differ from the literal language of the claims, or if they include equivalent elements with insubstantial differences from the literal language of the claims.

Unless defined otherwise, all technical and scientific terms used herein have the same meanings as commonly understood by one of skill in the art to which the disclosed invention belongs. All citations referred herein are expressly incorporated by reference.

General Process

In one embodiment the application pertains to methods for removing one or more heavy metals such as arsenic, mercury, selenium, or any combination thereof from hydrocarbons comprising the one or more heavy metals. The specific hydrocarbons that may benefit from the instant process are not particularly limited and generally include liquid hydrocarbons that comprise one or more heavy metals that are to be reduced or eliminated. Suitable hydrocarbons may comprise crude, condensate, a slop oil, distillate, sludge, or any combination thereof.

The extracting aspects described herein remove many different types of arsenic, mercury, and/or selenium species with representative mercury species including, for example, any mercury species that may form a reaction product in the process that comprises a different speciation for mercury than the original mercury species in the hydrocarbon. In particular, the processes described herein are effective for those original mercury species that are dissolved or otherwise suspended in hydrocarbons and then extracted to an aqueous phase that tend to form a dissolved species, and/or a precipitate or other solid when subjected to the steps described herein.

In general, the processes comprises dissolving one or more heavy metals within the hydrocarbons with an additive composition. The dissolved one or more heavy metals from the hydrocarbons are extracted into an aqueous phase. The aqueous phase is separated from the hydrocarbons. The additive composition generally comprises an effective amount of a heavy metal dissolving additive.

The aqueous phase may comprise a heavy metal precipitating agent such that a heavy metal such as mercury is reacted with the heavy metal precipitating agent to produce a reaction product. The reaction product usually comprises a different speciation for heavy metal such as mercury than the original mercury species. At least a portion of the reaction product is then removed from the aqueous phase.

Dissolving

The heavy metal such as mercury species within the hydrocarbons are dissolved with an additive composition to produce a dissolution product. The dissolution conditions are not particularly critical so long as the desired dissolution product or products are formed which can be at least partially extracted from the hydrocarbons into an aqueous phase. The specific conditions may differ depending upon, for example, the hydrocarbon composition, the heavy metal such as mercury species in the hydrocarbon composition, the desired product, the equipment employed, and the desired results.

Typically, the dissolution may occur in any convenient manner. For example, in some embodiments the additive composition may be a component of a wash water solution that is mixed with the hydrocarbons in a mixing vessel. In other embodiments the additive composition may be added to a feed of the hydrocarbons before the hydrocarbons are introduced into a reactor. In other embodiments the additive composition may be added to a mixture of produced hydrocarbons and co-produced water. If a reactor is employed, then the hydrocarbons and the additive composition may be introduced into a reactor on a continuous basis, a batch basis, or a combination thereof.

The dissolution of the heavy metal such as mercury species comprising the hydrocarbons with the additive composition may be performed in any convenient vessel which may vary depending upon, for example, the origin of the hydrocarbons. In some embodiments, the dissolution of the heavy metal such as mercury species comprising the hydrocarbons with the additive composition may be performed in a dedicated reactor such as a continuous stirred tank reactor. In other embodiments the dissolving may occur in, for example, a mixing tank, a storage tank, or in a pipe with a static mixer, or in a pipe with equipment or bends for mixing and/or residence time, and/or any combination thereof.

Extracting

The dissolving step generally produces a reaction product with one or more dissolved metals such as mercury in the hydrocarbons. At least a portion up to all of the reaction product formed is then extracted from the hydrocarbons into an aqueous phase. The specific manner of extracting is not particularly critical and may depend upon, for example, the original hydrocarbon composition, the heavy metal such as mercury species in the original hydrocarbon composition, the amount and type of the reaction product, the equipment employed, and the desired amount of extraction.

In situations where the aqueous phase comprises an effective amount of a heavy metal dissolving additive or one is added then a heavy metal precipitate may result in the aqueous phase. In those cases, solid suitable removing steps may be undertaken that comprise, for example, a solid-liquid separation process. The specific solid-liquid separation process is not particularly limited and may comprise filtration, centrifugation, sedimentation, flotation, or any combination thereof. In other embodiments, the extracting may comprise steps such as, for example, desalting, water washing, sulfidic extraction, pH adjustment, or any combination thereof.

Additive Compositions

The additive compositions useful herein vary depending upon, for example, such factors as the original hydrocarbon composition, the type and amount of heavy metal such as mercury species in the original hydrocarbon composition, the amount and type of the reaction product desired, the equipment employed, the desired amount of removal of heavy metal such as mercury, and/or the other steps employed.

Typically, useful additive compositions herein may comprise an effective amount of heavy metal dissolving additive. Such additives are not particularly limited so long as they dissolve heavy metals as desired. In one embodiment the heavy metal dissolving additive comprises 2,2'-(Ethylenedioxy) diethanethiol (DODT).

Heavy Metal Dissolving Additive Such as Sulfur Donating Substances

As described above, the one or more heavy metals are dissolved in the hydrocarbons and then extracted into an aqueous phase. If desired, a heavy metal precipitating agent may be added to the aqueous phase prior to extraction, subsequent to extraction, or both. Such heavy metal precipitating agent may comprise a sulfur donating substance.

The specific sulfur donating substance and amount may vary depending upon, for example, the type and amount of heavy metal such as mercury species in the original hydrocarbon composition, the amount and type of the precipitate desired, and the amount and type of other components. Taking as an example to illustrate the processes pertaining to this application, the sulfur donating substance may comprise a sulfide, a thiolate functionalized solid, a thiol, a dithiol, a dithiolcarbamate, or any combination thereof. In some embodiments, the sulfur donating substance may further comprise a polymer such as, for example, a NALMET™ compound from Nalco and/or a METCLEAR™ compound available from GE/Suez.

Representative sulfides in the additive compositions may include, for example, those compositions wherein the sulfide is $Na_2S$, $(NH_4)_2S$, a polysulfide having the formula MSx wherein M is selected from $Na_2$, $K_2$, or Ca, or any combination thereof. Representative thiolate functionalized solids in the additive compositions may include, for example, self-assembled monolayers on mesoporous supports (SAMMS), a functionalized silica gel (SiliaMetS), or any combination thereof. Representative dithiols may comprise 1,3,4-thiadiazole-2,5-dithiol (TDT).

As described above, the amount of sulfur donating substance in the aqueous phase may vary. Typically, the amount employed depends upon how much heavy metal such as mercury is to be removed and the specific sulfur donating substance. In many applications the amount of sulfur donating substance is at least about 1, or at least about 5, or at least about 10, or at least about 25 ppm in the aqueous phase. On the other hand, the amount of sulfur donating substance may be present in an amount of up to about 400, or up to about 400, or up to about 200, or up to about 100, or up to about 50 ppm.

The additive composition may also comprise water and other solvents so long as they do not substantially interfere with the desired dissolving and subsequent extracting. Similarly, additional optional ingredients for the additive composition may be added so long as they do not substantially interfere with the desired heavy metal such as mercury removal.

The above description is also applicable to certain additives that comprise sulfur and/or nitrogen in the chemical structure such as, for example, functionalized silica gel (SiliaMetS) with cysteine, diamine on the chemical structure.

EXAMPLES

Example 1—DODT Water Washing Crude

The following representative procedure was followed:

Determine initial Hg concentration in each feed;

Pre-filter feed by 0.45 micron filter. Determine mercury concentration after 0.45 micron filter.

Add 0 or 100 ppm DODT in approximately 10-20 ml of Crude A. Mix at RT for 2 hr on shake table. Measure Hg concentration after 0.45 micron filtration.

Wash reacted feed with 1:1 wash water (DI with or without additives). Mix at RT (room temperature) for 2 hr on shake take.

Allow to separate at RT for 2 hr. Take sample of feed and measure by mercury analyzer. Make note of the emulsion.

Allow to separate at RT overnight. Take sample of feed and measure by mercury analyzer. Make note of the emulsion.

The results with Crude A are shown in the tables below. DODT column is the concentration of DODT in the feed. Wash water column is the composition of the wash water. Initial is the initial Hg concentration in the feed in ppbW. 0.45 um column is the Hg concentration after filtering the feed by a 0.45 micron filter. 2 hr and 24 hr column is the Hg concentration after reaction with DODT and extraction with a wash water after 2 hr and 24 hr of separation time.

| Experiment | DODT | Wash water | Initial | 0.45 um | 2 hrs | 24 hrs |
|---|---|---|---|---|---|---|
| 1 | None | DI water | 9573 | 329 | 218 | 148 |
| 2 | 100 ppm | DI water | 9573 | 277 | 152 | 136 |
| 3 | 100 ppm | pH 10 water (by NaOH) | 9573 | 271 | 143 | 144 |
| 4 | 100 ppm | 1000 ppm (NH4)2S | 9573 | 275 | 56 | 42 |
| 5 | 100 ppm | 1000 ppm TDT | 9573 | 278 | 113 | 82 |
| 6 | 100 ppm | 1000 ppm DODT | 9573 | 285 | 155 | 142 |
| 7 | None | 1 wt % DODT | 9573 | 320 | 158 | 104 |
| 8 | None | 1 wt % DODT at pH 10 (by NaOH) | 9573 | 322 | 158 | 137 |

Figure 10:
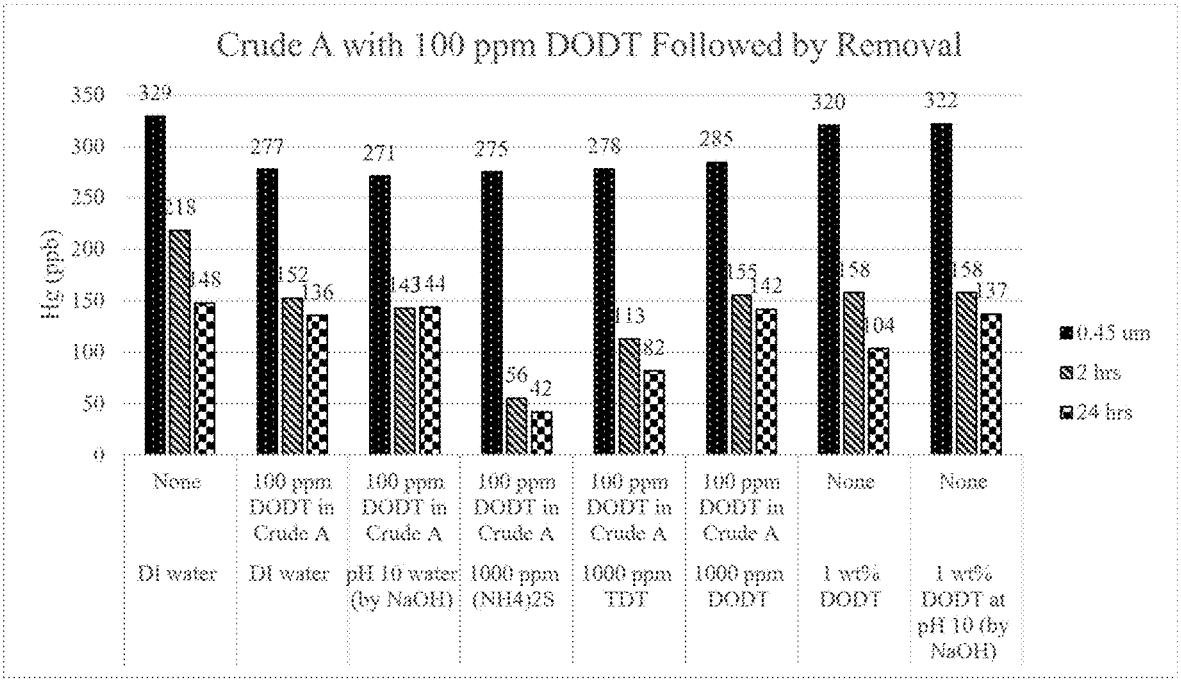
FIG. 10 shows mercury after treatment in Example 1.

FIG. 10 shows the amount of mercury after treatment in each of the samples. The initial mercury concentration before treatment is 9,573 ppb. 0.45 μm is after filtration by 0.45 μm before treatment. 2 hrs is after reaction (None, 100 ppm DODT) followed by extraction by a wash water (DI water, pH 10, 1000 ppm TDT, etc.) and a separation time of 2 hr. 24 hr is similar except for having a separation time of 24 hr.

Example 2

Example 1 was repeated with Crude A. The results are shown in the Tables below. DODT column is the concentration of DODT in the feed. Wash water column is the composition of the wash water. Initial is the initial Hg concentration in the feed in ppbW. 0.45 um column is the Hg concentration after filtering the feed by a 0.45 micron filter. 2 hr and 24 hr column is the Hg concentration after reaction with DODT and extraction with a wash water after 2 hr and 24 hr of separation time.

| Experiment | DODT | Wash water | Initial | 0.45 um | 2 hrs | 24 hrs |
|---|---|---|---|---|---|---|
| 1 | None | DI water | 8980 | 252 | 222 | 211 |
| 2 | 100 ppm | DI water | 8980 | 252 | 247 | 215 |
| 3 | 100 ppm | pH 10 water (by NaOH) | 8980 | 252 | 246 | 210 |
| 4 | 100 ppm | 1000 ppm (NH4)2S | 8980 | 252 | 200 | 105 |
| 5 | 100 ppm | 1000 ppm TDT | 8980 | 252 | 226 | 131 |
| 6 | 100 ppm | 1000 ppm DODT | 8980 | 252 | 220 | 205 |
| 7 | None | 1 wt % DODT | 8980 | 252 | 206 | 178 |
| 8 | None | 1 wt % DODT at pH 10 (by NaOH) | 8980 | 252 | 213 | 179 |

Upstream Representative Uses

1. Injection of a heavy metal dissolving additive in hydrocarbon near well head chemical injection point with pipe mixing for reaction; and/or
2. Injection of a precipitating additive in the produced water before oil-water or other bulk separator; and/or
3. Separation of the produced water and injection into disposal well or treatment in existing water treatment system.

Upstream/Downstream Representative Uses

1. Injection of dissolving additive in hydrocarbon in storage tank. Pump mix tank to facilitate reaction; and/or
2. Introduce aqueous phase containing precipitating additive to tank. Pump mix tank to facilitate reaction/extraction; and/or
3. Separation of the aqueous phase and injection into disposal well or treatment in existing water treatment system.

Representative Specific Process Embodiments for

Additive composition+Filtration: As shown in FIG. 1, the process may include the following steps in system 10: 1) Additive composition 16 is dosed into hydrocarbon feed 12, 2) Additive composition 16 and hydrocarbon feed dissolve and extract in a continuous stirred tank reactor (CSTR) 14 or other type of reactor 14 where heavy metal such as mercury species may be precipitated from an aqueous phase, 3a) Reacted hydrocarbon feed 18 and/or aqueous phase is then filtered 20; or 3b) Alternatively, other solid-liquid processes may be used in place of filtration 20 including sedimentation, flotation, centrifugation, electrostatic separation, etc. Some embodiments may use combinations of solid-liquid separations. 4) The process results in a low heavy metal such as mercury hydrocarbon product 22.

Figure 2:
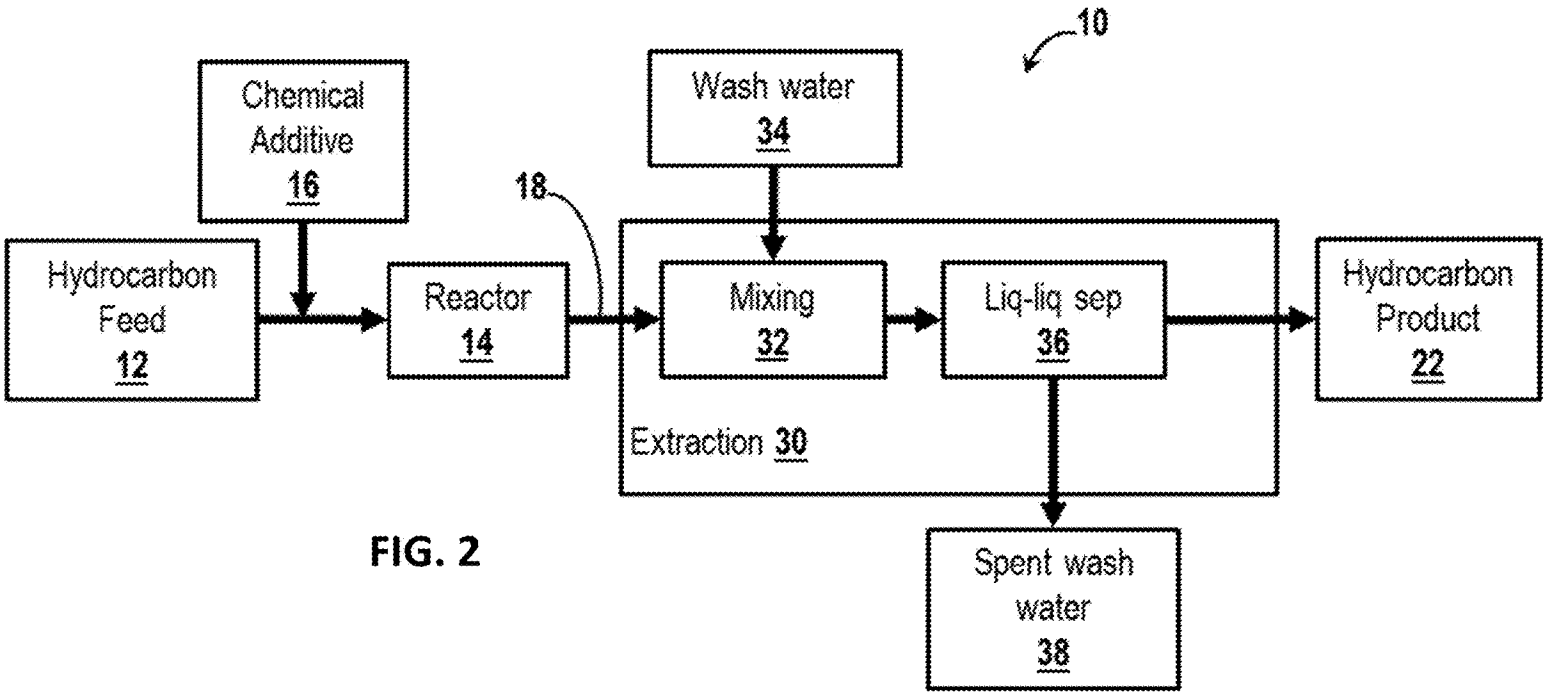
FIG. 2 depicts steps of a representative process.

Additive composition+water wash or sulfidic extraction: The example process of FIG. 2 includes the following steps in system 10: 1) Additive composition 16 is dosed into hydrocarbon feed 12, 2) Additive composition 16 and hydrocarbon feed 12 react in a CSTR or other type of reactor 14 where heavy metal such as mercury species are dissolved, extracted, and/or precipitated, 3) Reacted hydrocarbon feed 18 and/or aqueous phase is then mixed 32 with water 34 or an additive composition such as described herein, separated 36, 4) Results in a low heavy metal such as mercury hydrocarbon product 22, 5) Spent wash water 38 or sulfidic solution is treated or disposed.

Figure 3:
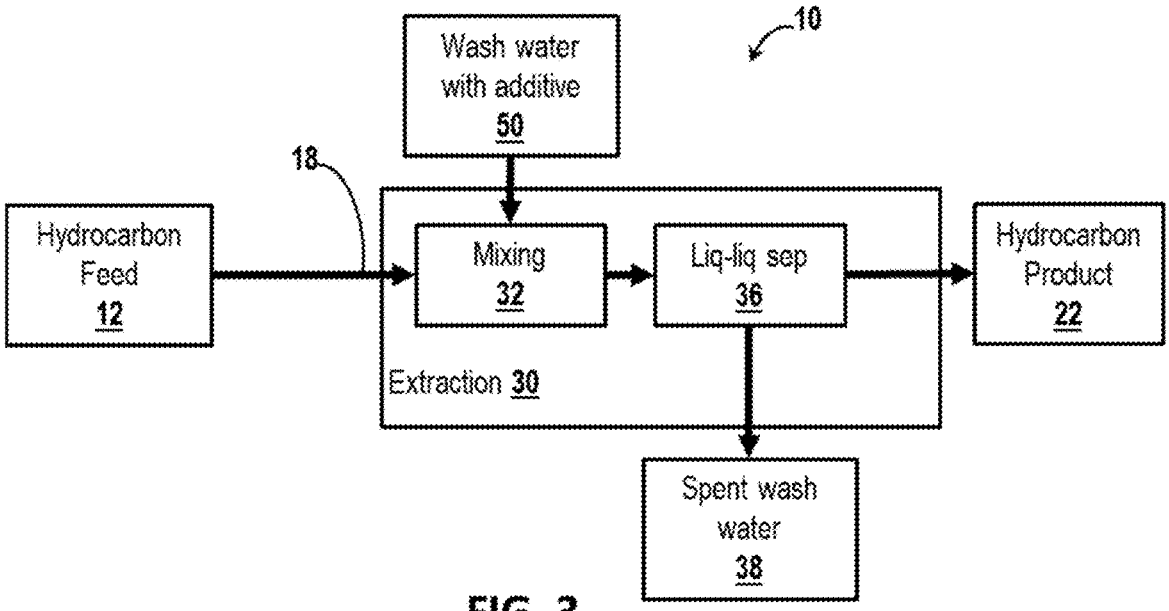
FIG. 3 depicts steps of a representative process.

Water wash or sulfidic extraction: The example process of FIG. 3 includes the following steps in system 10: 1) Feed 12 is mixed 32 with a wash water 50 with additive composition 18 or sulfidic solution and separated 36, 2) The spent wash water 38 or sulfidic solution is separated from the feed, 3) Results in a low heavy metal mercury hydrocarbon product 22, 4) Spent wash water 38 or sulfidic solution is treated or disposed.

Figure 4:
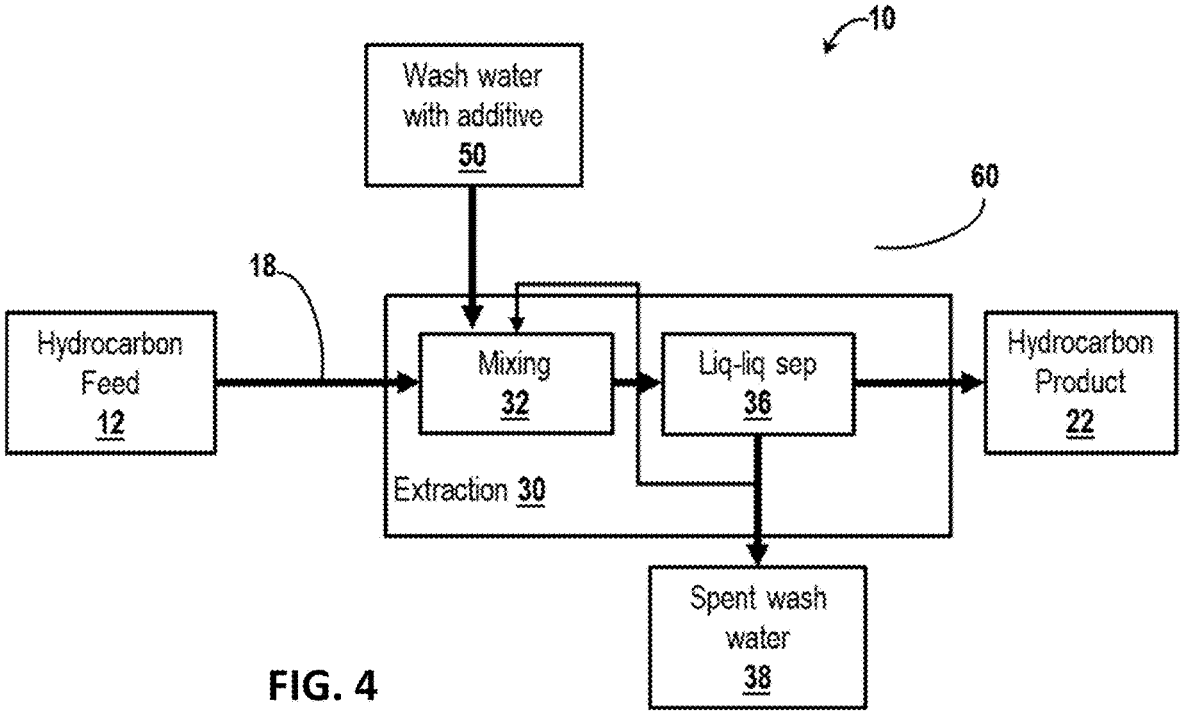
FIG. 4 depicts steps of a representative process.

Water wash or sulfidic extraction with recycling: The process of system 10 in FIG. 4 is the same as FIG. 3, except with a recycle loop on the water wash/sulfidic extraction solution. A fraction of fresh wash water or sulfidic extraction solution is added with an equal volume being discharged for treatment or disposal. This will reduce the amount of water/sulfidic solution needed.

Process options: Several options exist for implementation of the disclosed processes. Non-limiting examples of process options are provided below.

Overall: The overall process may be batch or continuous.

Additive compositions and heavy metal precipitating agents are as described above. Those may be used alone or in combination with each other and/or other glycols or acids, such as (ethylene glycol (MEG), triethylene glycol (TEG)) or terephthalic acid (or similar) may also increase removal.

Reactor: The reactor used in the disclosed process may be a continuous stirred tank reactor (CSTR), or any other dedicated reactor. By way of non-limiting example, the reactor may include an existing tank with mixer or recirculation pump (e.g., a floating storage and offloading (FSO) storage tank, a D/S storage tank, a U/S oil treatment tank). By way of another non-limiting example, the reactor may include a pipe and static mixer (e.g., a desalter). By way of further non-limiting example, the reactor may include a pipe with equipment or bends for mixing and residence time (e.g., a wellhead chemical injection, injection before a heat exchanger, a separator with baffles).

Solid-liquid separation: Solid-liquid separation as used in the disclosed process may be performed using a variety of techniques. By way of non-limiting example, such separation techniques may include filtration, centrifugation, sedimentation (e.g., in a cargo hold, in an oil storage tank), or flotation.

Extraction: The extraction used in the disclosed process may be performed using a variety of techniques and associated equipment. Non-limiting examples include using a desalter. As another non-limiting example, the extraction may include washing using an existing tank with a mixer, recirculation pumps, and spray nozzles. As another non-limiting example, the extraction may include sulfidic extraction. Extraction may include water washing, which may or may not include performing pH adjustments and/or the use of a further additive or additives. Extraction may further include recycling of wash water and/or the sulfidic extraction solution.

Wash water/additive solutions source: The water source of the wash water and/or sulfidic solution may include, by way of non-limiting example, fresh water, fresh process water, recycle/spent water, or a non-freshwater source. Non-limiting examples of recycle/spent water include cooling tower blowdown, stripped sour water, and desalter brine water. Non-limiting examples of non-freshwater sources include seawater and produced water.

Spent wash water/sulfidic additive solution disposal: Disposal of the spent wash water and/or sulfidic solutions used in the disclosed processes may include treatment and/or direct disposal in a disposal well. Disposal may include disposal in an injection well alone or after a combination of other injection streams such as produced water and/or refinery wastewater. Treatment of the spent wash water and/or sulfidic additive solution for eventual disposal may be performed using an existing treatment system or using a dedicated aqueous treatment system. Existing treatment systems may include treatment systems used for produced water (e.g., gravity separators, gas flotation, media filtration/adsorption, chemical treatment) or refinery effluent systems (e.g., gravity separators, flotation, chemical flocculation/coagulation, bioreactors, media filtration/adsorption). A dedicated treatment system for spent wash water and/or sulfidic solutions ay include a system dedicated to mercury and/other heavy metal removal.

Emulsion removal and disposal: The emulsion phase, which may be withdrawn with the spent wash water/additive solution may contain significant concentrations of mercury. Separation and treatment of this stream may be a beneficial part of the process. The oil/hydrocarbon and aqueous phase may be separated from the emulsion by gravity separation, flotation, centrifugation, or other processes. The aqueous phase can be disposed of or recycled in the process. The oil/hydrocarbon phase may be disposed or treated further by filtration, centrifugation, or other methods and combined with the low mercury produced. The solids removed by the separation process may contain higher mercury and may require disposal.

Chemical injection upstream of desalter. In this example embodiment, the reaction between mercury and the additive composition occurs in pipes and at a desalter mixing valve. Mercury partitions from the crude oil to the desalter brine water and emulsion phase. The desalter brine water and optionally the emulsion phase is withdrawn to the effluent treatment plant. Mercury is removed in the process units in the effluent treatment plant including any one or a combination of the following: sedimentation, activated carbon or other adsorbents, gravity separators (API separators), flotation, and/or a bioreactor.

Chemical injection upstream of oil treatment process in upstream. In this example embodiment, additive compositions are injected near the wellhead or before oil/water separation tanks. Turbulence and long pipe run allow enough residence time for the additive composition to react with mercury. Mercury is separated out in the oil/water separation processes (tanks with baffles) or other solid-liquid separations units (filters, centrifuges).

Water washing/extraction in FSO cargo tanks, or other oil storage tanks. Feed with an initial concentration of mercury is placed in a holding tank. Water is pumped into a tank to a volume large enough to allow recirculation of water. Additive compositions and/or heavy metal precipitating agents are added to either the oil phase, aqueous phase, or both. The water and/or emulsion phase is pumped into the oil phase directly or with nozzles to allow for mixing of the water and oil phases. This may continue for several volumes or until heavy metal such as mercury concentrations decrease in the oil phase. The pumps are turned off to allow the water and oil phases to separate. The water and/or emulsion phase is removed to result in a lower heavy metal such as mercury concentration in oil. In certain embodiments, this process may also be used for sulfidic extraction. In another embodiment, the pump may withdraw from both the oil and water phase to a static mixer before returning to the tank for enhanced mixing. In another embodiment, in a continuous process oil and water can be pumped to a static mixer before the tank. Water and oil would then be continuously withdrawn from the tank. In the water washing/extraction process, the spent wash water/sulfidic solution may be disposed in an injection well alone or with other aqueous streams (e.g., produced water, refinery wastewater).

Example Visualization: The figures described below provide example visualizations for embodiments of the water washing/extraction in vessels, such as FSO cargo tanks, or other oil storage tanks. In the depicted embodiments below, the hydrocarbon phase will generally have a reduced mercury concentration relative to its source.

Figure 5:
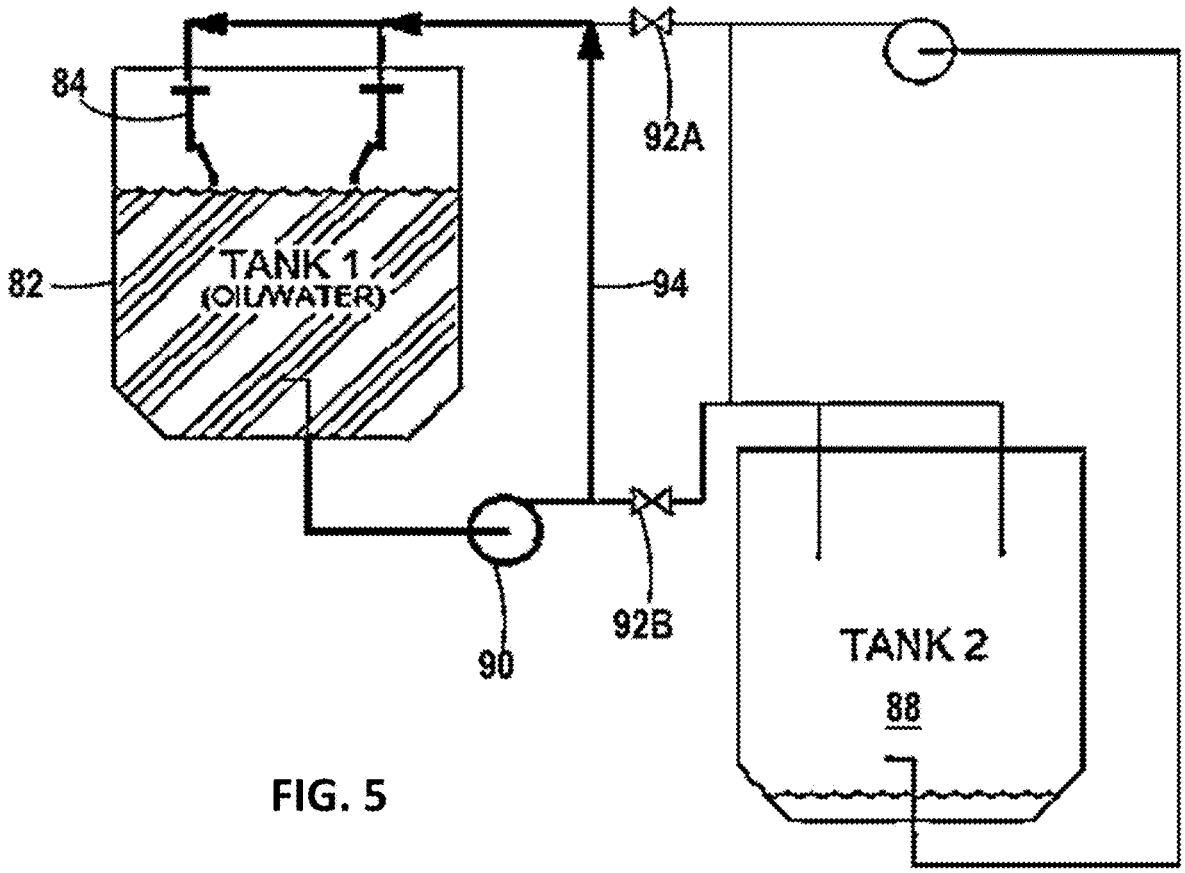
FIG. 5 depicts steps of a representative process.

FIG. 5 depicts a multi-tank system (e.g., a two-tank system) that utilizes water/oil circulation to maximize mixing between the aqueous and oil phases. One of the tanks, such as a storage tank, may be outfitted with crude oil wash (COW) nozzles. The nozzles rotate to allow for distribution and mixing. In this example, pump 1 and the COW nozzles are used for an initial transfer of water (e.g., an aqueous solution with additive compositions) from tank 2 to tank 1 with metal-containing hydrocarbons. Pump 2 is then utilized, along with a series of valves and the COW nozzles, to recirculate the mixture to enhance mixing. This allows the additive compositions and/or heavy metal precipitating agents in the aqueous phase to interact with the heavy metals (e.g., mercury) in the hydrocarbons.

Alternative embodiments for the disclosed process used with water washing/extraction in FSO cargo tanks, or other oil storage tanks are depicted below. In particular, FIGS. 6-8 depict embodiments where the aqueous and oil phases are mixed using recirculation, and optionally additional features.

Figure 6:
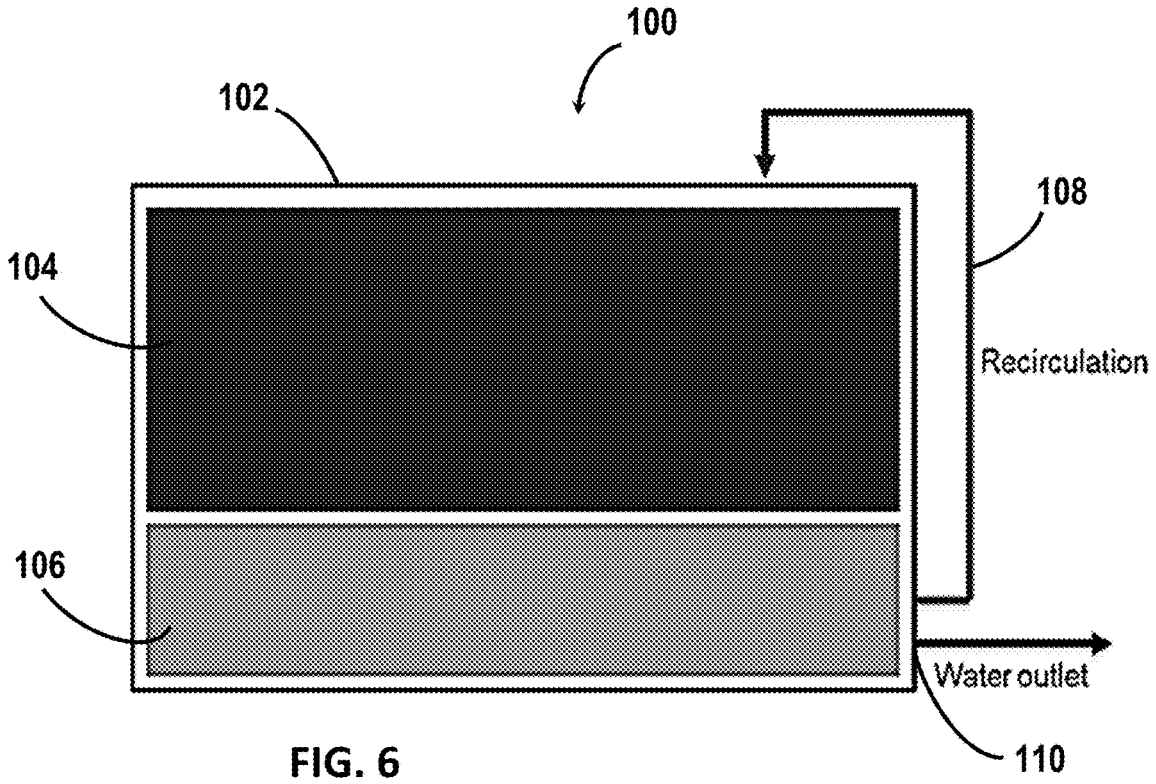
FIG. 6 depicts steps of a representative process.

FIG. 6 FIG. 6 depicts an embodiment of a system 100 including a storage tank 102 where an oil/hydrocarbon phase 104 and an aqueous phase 106 containing the chemical additive 16 are present. As shown, the phases will separate and to encourage mixing, the aqueous phase 106 is recirculated via introduction above the oil/hydrocarbon phase 104 using a recirculation loop 108. The aqueous phase 106 is withdrawn from a water outlet 110 at a level of the tank 102 corresponding to the aqueous phase 106 and reintroduced to the tank 102 into the oil phase 104. This may be considered a batch process.

Figure 7:
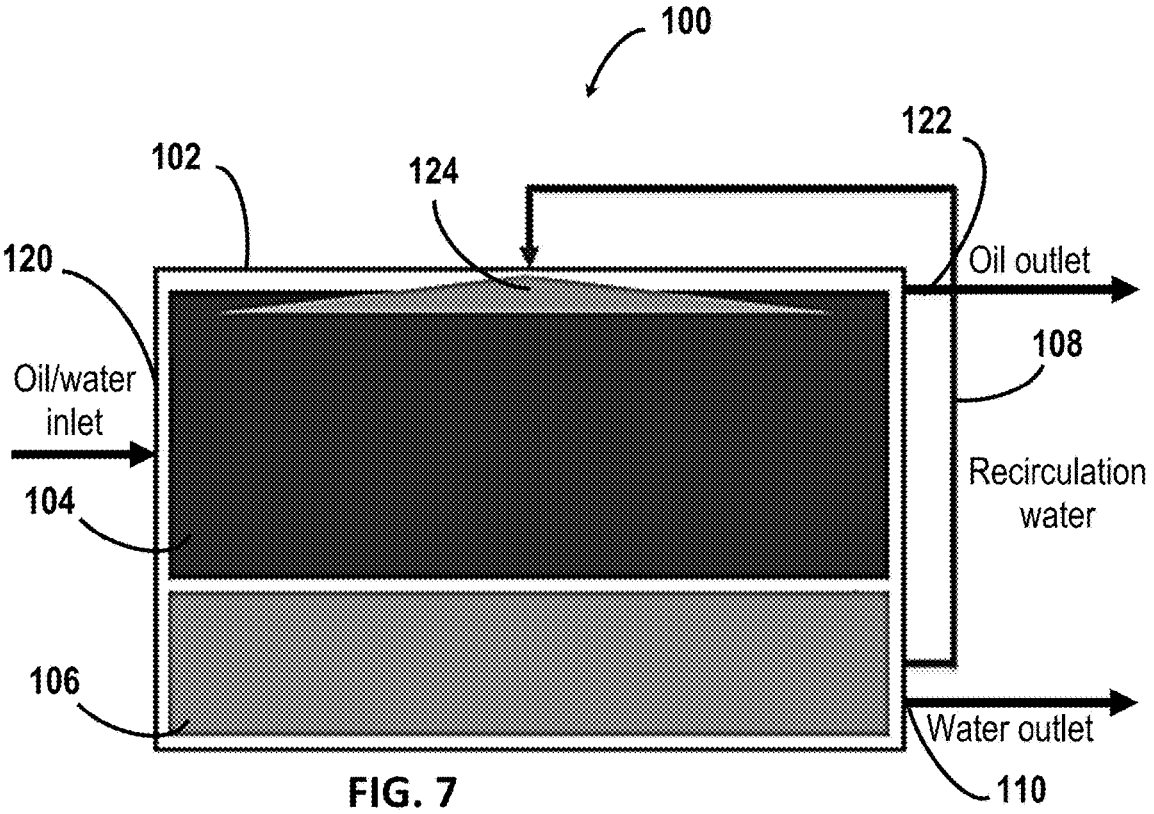
FIG. 7 depicts steps of a representative process.
Figure 8:
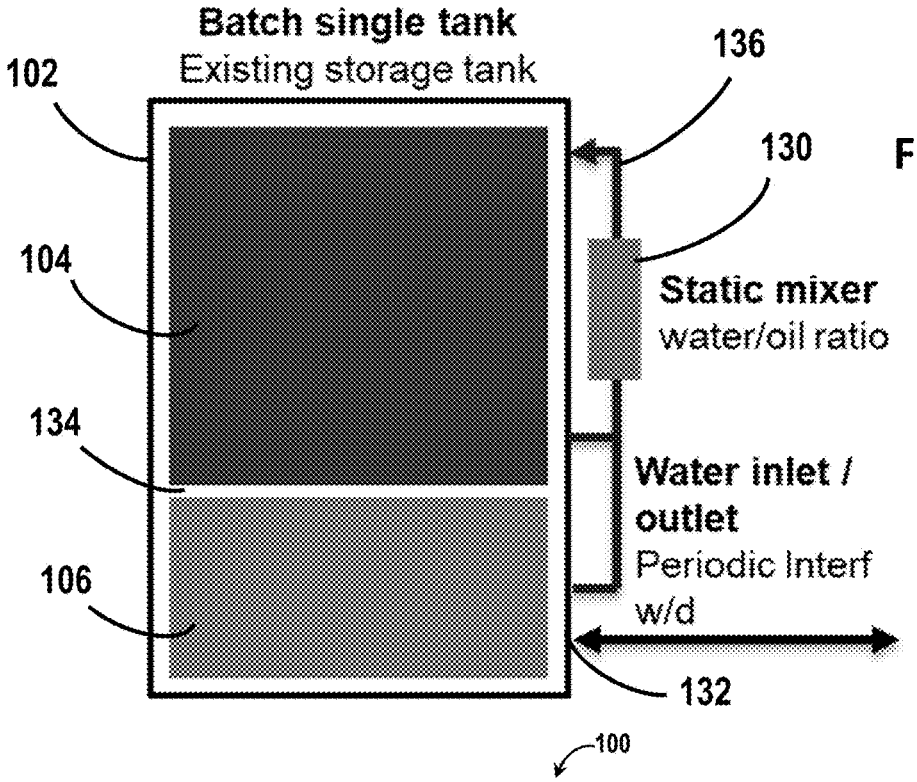
FIG. 8 depicts steps of a representative process.

FIG. 7 depicts an embodiment of a continuous version of the system 100, including an oil/water inlet 120 for introduction of either or both of a hydrocarbon feed (e.g., hydrocarbon feed 12), water (e.g., wash water 34), and additives (e.g., chemical additive 16). These may be provided as a mixture, as mixtures, or individually at separate times to the tank 102. This may be considered a continuous process, but a batch approach is also contemplated.

The tank 102 also includes an oil outlet 122 in addition to the water outlet 110 to allow for, after a degree of settling, the separate removal of both the hydrocarbon phase (e.g., as the treated hydrocarbon product 22) and the aqueous phase (e.g., as the spent wash water 38). As with the system 100 of FIG. 6, the system 100 of FIG. 7 includes the recirculation loop 108 to enable recirculation of the aqueous phase 106. The reintroduction of the aqueous phase 106 may be done above the oil phase 104 using a COW nozzle 124. Advantageously, the system 100 of FIG. 7 may be operated in a continuous or batch mode using appropriate flow control equipment.

Figure 9:
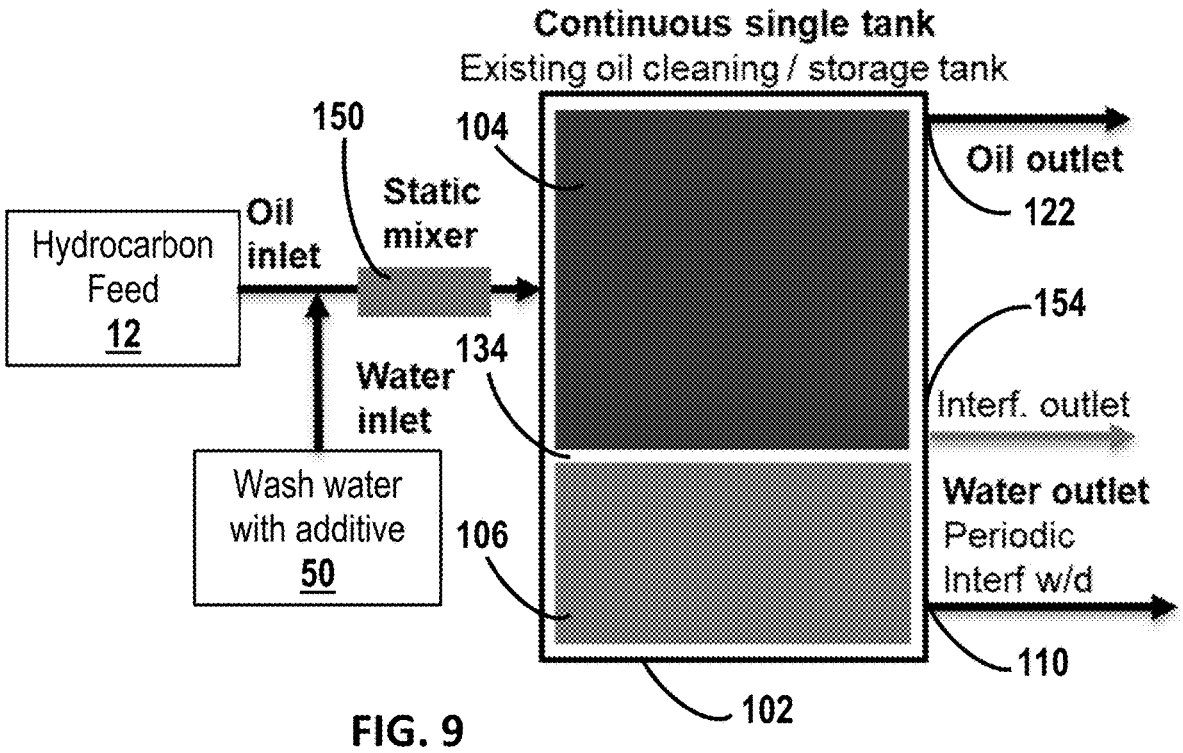
FIG. 9 depicts steps of a representative process.

Certain embodiments of this disclosure may utilize a static mixer 130 situated outside (or, in other embodiments, inside) of the tank 102, as shown in FIGS. 8 and 9. FIG. 8 depicts an embodiment where a batch process uses the storage tank 102 and includes water inlet/outlet options 132 for direct injection of the aqueous phase 106 into the hydrocarbon phase 104, and/or withdrawal of both hydrocarbons and the aqueous phase at a position proximate their interface 134 (e.g., as an emulsion phase). Both withdrawn streams may be mixed in the static mixer 130 in a particular ratio and the resulting mixture 136 may be reintroduced to the top of the hydrocarbon phase 104 (away from the interface of both phases) to encourage diffusion/mixing. The ratio may be controlled by the rate of withdrawal of the phases, which may be performed by one or more flow control devices including valves, pumps, and so forth.

FIG. 9 depicts an embodiment of a continuous treatment configuration that utilizes a static mixer 150 upstream of the tank 102 In this example embodiment, water and oil (e.g., an aqueous solution with an additive and the hydrocarbons, respectively) are introduced to the static mixer 150, which then introduces a mixture 152 of these into the tank 102.

The tank 102 of FIG. 9 includes the oil outlet 122 for the hydrocarbons, an outlet 154 for an emulsion phase proximate the interface 134 between the hydrocarbon and aqueous phases, and a water outlet. The rate of injection of water and oil may be balanced with the rate of withdrawal of the hydrocarbons, water, and emulsion phase.

It will be understood that various modifications may be made to the embodiments disclosed herein. Therefore, the above description should not be construed as limiting, but merely as exemplifications of example embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A method for removing one or more heavy metals from hydrocarbons, comprising:

dissolving one or more heavy metals within the hydrocarbons with an additive composition; and extracting the dissolved one or more heavy metals from the hydrocarbons into an aqueous phase; and separating the aqueous phase from the hydrocarbons;

wherein the additive composition comprises an effective amount of a heavy metal dissolving additive and wherein the aqueous phase comprises a heavy metal precipitating agent selected from a dithiol, a dithiocarbamate, a thiol and a polymer, a dithiol and a polymer, a dithiocarbamate and a polymer, $(NH_4)_2S$, and any combination thereof.

2. A method for removing one or more heavy metals from hydrocarbons, comprising:

dissolving one or more heavy metals within the hydrocarbons with an additive composition; and extracting the dissolved one or more heavy metals from the hydrocarbons into an aqueous phase; and separating the aqueous phase from the hydrocarbons;

wherein the additive composition comprises an effective amount of a heavy metal dissolving additive, wherein the heavy metal dissolving additive is 2,2'-(Ethylenedioxy)diethanethiol (DODT).

3. A method for removing one or more heavy metals from hydrocarbons, comprising:

dissolving one or more heavy metals within the hydrocarbons with an additive composition; and extracting the dissolved one or more heavy metals from the hydrocarbons into an aqueous phase; and separating the aqueous phase from the hydrocarbons;

wherein the additive composition comprises an effective amount of a heavy metal dissolving additive, wherein the aqueous phase comprises a heavy metal precipitating agent, and wherein the heavy metal precipitating agent comprises $(NH_4)_2S$, 1,3,4-thiadiazole-2,5-dithiol, or any combination thereof.

4. A method for removing one or more heavy metals from hydrocarbons, comprising:

dissolving one or more heavy metals within the hydrocarbons with an additive composition; and extracting the dissolved one or more heavy metals from the hydrocarbons into an aqueous phase; and separating the aqueous phase from the hydrocarbons;

wherein the additive composition comprises an effective amount of a heavy metal dissolving additive, wherein the aqueous phase comprises a heavy metal precipitating agent, and wherein the heavy metal precipitating agent comprises a thiolate functionalized solid comprising self-assembled monolayers on mesoporous supports (SAMMS), a functionalized silica gel (SiliaMetS), or any combination thereof.

5. A method for removing one or more heavy metals from hydrocarbons, comprising:

dissolving one or more heavy metals within the hydrocarbons with an additive composition; and extracting the dissolved one or more heavy metals from the hydrocarbons into an aqueous phase; and separating the aqueous phase from the hydrocarbons;

wherein the additive composition comprises an effective amount of a heavy metal dissolving additive, wherein the aqueous phase comprises a heavy metal precipitating agent, wherein the heavy metal precipitating agent comprises a thiol, a dithiol, or a dithiocarbamate, and wherein the dithiol comprises 1,3,4-thiadiazole-2,5-dithiol (TDT).

6. The method of claim 2, wherein the hydrocarbons comprise a crude, a condensate, a slop oil, a distillate, or any combination thereof.

7. The method of claim 2, wherein the one or more heavy metals comprise mercury, arsenic, selenium, or any combination thereof.

8. The method of claim 2, which further comprises separating particulate mercury prior to dissolving, subsequent to extracting, or both.

9. The method of claim 2, wherein the additive composition is a component of a wash water solution that is mixed with the hydrocarbons in a mixing vessel.

10. The method of claim 2, wherein the dissolving comprises adding the additive composition to the hydrocarbons and then introducing before the hydrocarbons into a reactor.

11. The method of claim 2, wherein the dissolving comprises introducing the hydrocarbons and the additive composition into a reactor on a continuous basis.

12. The method of claim 2, wherein the hydrocarbons and the additive composition are introduced into a reactor and are mixed in a batch process.

13. The method of claim 2, wherein the dissolving of the one or more heavy metals in the hydrocarbons with the additive composition is performed in a dedicated reactor, in a mixing tank, in a pipe with a static mixer, in a pipe with equipment or bends for mixing and residence time, or any combination thereof.

14. The method of claim 13 wherein the dedicated reactor is a continuous stirred tank reactor.

15. The method of claim 2, which further comprises a solid-liquid separation process.

16. The method of claim 15, wherein the solid-liquid separation process comprises filtration, centrifugation, sedimentation, flotation, or any combination thereof.

17. The method of claim 2, wherein the extracting comprises desalting, water washing, sulfidic extraction, pH adjustment, or any combination thereof.

* * * * *